US005562439A

United States Patent [19]

VanWagner

[11] Patent Number: 5,562,439

[45] Date of Patent: Oct. 8, 1996

[54] LIGHTER OPERATING AID

[76] Inventor: Todd W. VanWagner, 9220 North, CR 925 West, Alexandria, Ind. 46001

[21] Appl. No.: 543,270

[22] Filed: Oct. 16, 1995

[51] Int. Cl.[6] ..... F23D 11/36

[52] U.S. Cl. ..... 431/153; 431/277

[58] Field of Search ..... 431/153, 276, 431/277, 255

[56] References Cited

U.S. PATENT DOCUMENTS

| | | | |
|---|---|---|---|
| D. 267,590 | 1/1983 | Varma | D27/51 |
| D. 308,929 | 7/1990 | Greig et al. | D8/34 |
| 3,895,903 | 7/1975 | Lefebvre | 431/143 |
| 4,049,370 | 9/1977 | Neyret | 431/153 |
| 4,122,852 | 10/1978 | Knetsch et al. | 128/303 |
| 4,479,495 | 10/1984 | Isaacson | 128/327 |
| 4,716,898 | 1/1988 | Chauve et al. | 128/329 |
| 4,758,152 | 7/1988 | Kordecki | 431/153 |
| 4,799,877 | 1/1989 | Bisbee | 431/153 |
| 4,832,596 | 5/1989 | Morris | 431/153 |
| 4,901,848 | 2/1990 | Parren | 206/86 |
| 5,078,728 | 1/1992 | Giarratano | 606/204 |
| 5,295,996 | 3/1994 | Blair | 606/203 |

*Primary Examiner*—Carroll B. Dority

*Attorney, Agent, or Firm*—Taylor & Associates, P.C.

[57] ABSTRACT

The invention is directed to a lighter operating aid for a gas-fueled lighter. The lighter includes a body with a fuel tank therein, an igniting mechanism including a thumb lever which controls a supply of fuel from the fuel tank, and a safety device which is movable between a first position allowing operation of the thumb lever and a second position preventing operation of the thumb lever. The lighter operating aid includes a sleeve for at least partially surrounding and engaging the body of the lighter, and a protuberance which extends from the sleeve. The protuberance is structured and arranged to maintain the safety device in the first position allowing operation of the thumb lever when the sleeve engages the lighter.

15 Claims, 1 Drawing Sheet

LIGHTER OPERATING AID

BACKGROUND OF THE INVENTION

1. Field of the Invention

The present invention relates to gas-fueled lighters, and, more particularly, to gas-fueled lighters having a safety device.

2. Description of the Related Art

Gas-fueled lighters, such as disposable butane lighters, are presently manufactured and sold with a safety device incorporated therein. The safety device is movable between a first position allowing operation of the thumb lever, and a second position preventing operation of the thumb lever. The safety device in essence makes the lighter a "single shot" lighter in which the thumb lever may only be depressed one time after the safety device is moved to the position allowing depressing of the thumb lever. Such safety devices have the intended purpose of preventing children from easily operating the lighter.

In reality, these safety devices have rendered gas-fuel lighters essentially inoperable for certain individuals. For example, these safety devices are quite small and require a substantial amount of manual dexterity in order to move the safety device to a position where the lighter may be used. Elderly persons, or persons with arthritis or other conditions affecting manual dexterity may not be able to use the lighter because of the safety device. Activities such as lighting a barbecue grill, burning trash, smoking or the like can therefore not be accomplished by such persons using these current types of gas-fueled lighters. Thus, such persons are forced to use matches in order to start a fire. Using matches may pose a safety problem since the matches are smaller than a lighter and may be fumbled or dropped after being lit.

Another problem is that such safety devices many times require the use of two hands in order to operate the lighter. However, the thumb lever and safety device are positioned closely adjacent to each other. For a person with large hands or limited manual dexterity, this makes the lighter very difficult if not impossible to operate.

Another problem associated with such gas-fueled lighters is that even those persons who do not require a safety device, because of the lack of children, may not be able to operate the lighter. Because of the extreme difficulty in operating lighters with such safety devices, these lighters have been the target of temper flare-ups, explicitives, etc., from the people who use them.

One known way of defeating the safety devices on presently sold gas-fueled lighters is to pry out and break the safety device with a screwdriver or other relatively sharp instrument. However, to accomplish this, the user must hold the lighter in one hand while prying the safety device out with the sharp instrument in the other hand. This may likely result in the user being stabbed or otherwise cut with the relatively sharp instrument used to pry out the safety device. Users of presently sold gas-fueled lighters may thus be injured by trying to pry out and remove the safety devices.

What is needed ill the art is a device which allows individuals with limited manual dexterity to still operate gas-fueled lighters.

What is further needed in the art is a device which allows individuals who do not require the use of a safety device because of the lack of children, etc., to use presently sold gas-fueled lighters with relative ease.

A still further need is a device which can be used to circumvent safety devices on presently sold gas-fueled lighters, which does not present potential injury to the user when defeating the safety device.

SUMMARY OF THE INVENTION

The present invention provides a sleeve which may be slidably engaged with a gas-fueled lighter, and which has a protuberance which maintains a safety device of the lighter in a position allowing repeated operation of the thumb lever.

The invention comprises, in one form thereof, a lighter operating aid for a gas-fueled lighter. The lighter includes a body with a fuel tank therein, an igniting mechanism including a thumb lever which controls a supply of fuel from the fuel tank, and a safety device which is movable between a first position allowing operation of the thumb lever and a second position preventing operation of the thumb lever. The lighter operating aid includes a sleeve for at least partially surrounding and engaging the body of the lighter, and a protuberance which extends from the sleeve. The protuberance is structured and arranged to maintain the safety device in the first position allowing operation of the thumb lever when the sleeve engages the lighter.

An advantage of the present invention is that individuals with poor manual dexterity caused by, e.g., arthritis, can successfully and relatively easily operate a gas-fueled lighter having a safety device.

Another advantage is that individuals in households having no children present (and thus no need for a safety device) can utilize gas-fueled lighters having a safety device with relative ease.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
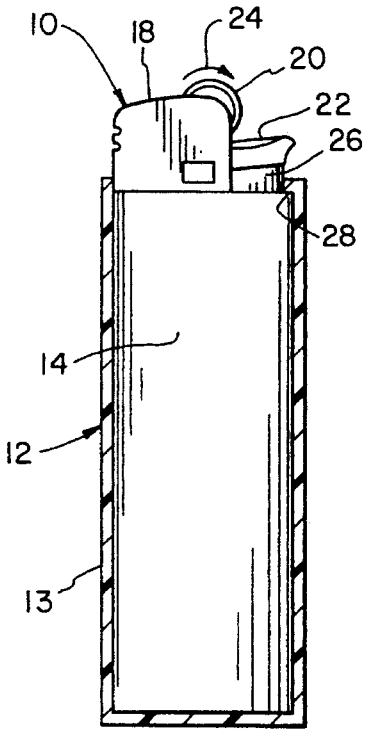
FIG. 1 is a side view of a gas-fueled lighter, with an embodiment of a lighter operating aid in the form of a sleeve shown in section thereabout.

Referring now to the drawings and particularly to FIG. 1, there is shown a side view of a gas-fueled lighter 10, with an embodiment of a lighter operating aid 12 of the present invention including a sleeve 13 shown in cross-section thereabout.

Lighter 10 includes a body 14 with a fuel tank (not shown) therein. An igniting mechanism 18 is attached to body 14, and is used to produce a flame with lighter 10. Igniting mechanism 18 includes a thumb wheel 20 and a thumb lever 22. Thumb lever 22 controls a supply of fuel from the fuel tank within body 14. Thumb wheel 20 produces a spark when rotated, as indicated by arrow 24, such that the exhausted fuel is ignited. Alternatively, an electronic ignition system or other device for igniting the exhausted fuel can be used.

Lighter 10 also includes a safety device 26 which is movable between a first position allowing operation of thumb lever 22 (FIG. 1), and a second position preventing operation of thumb lever 22, to be described hereinafter.

Lighter operating aid 12, in the embodiment shown in FIG. 1, is in the form of a cover or sleeve 13 which substantially covers lighter body 14. The term "sleeve" as used herein is intended to broadly mean a device which surrounds at least a portion of the periphery of the lighter, such as a sleeve, cover, strap, band, ring, collar, etc. The important criteria is that such a sleeve is capable of supporting a protuberance which is attached to or integral therewith, as will be discussed hereinafter.

Sleeve 14 includes a protuberance 28 which is monolithic therewith and extends therefrom. Protuberance 28 is structured and arranged to maintain safety device 26 in the first position shown in FIG. 1, thereby allowing operation of thumb lever 22 when sleeve 12 is disposed about and engages lighter 10.

Figure 2:
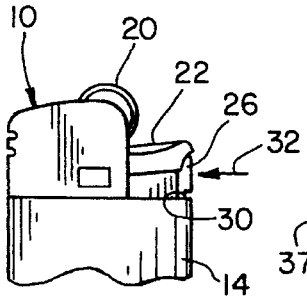
FIG. 2 is a fragmentary, side view of the lighter shown in FIG. 1 without the sleeve thereabout, and with the safety device shown in a position preventing operation of the thumb lever.
Figure 3:
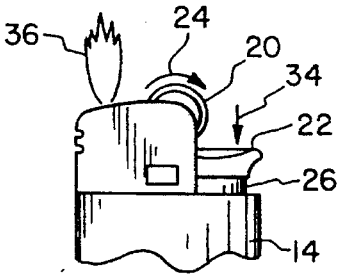
FIG. 3 is a fragmentary, side view of the lighter shown in FIG. 2, with the safety device shown in a position allowing operation of the thumb lever.

Referring now to FIGS. 2 and 3, lighter 10 as shown in FIG. 1 is illustrated in greater detail for the purpose of describing one embodiment of a safety device 26 which may be overcome with lighter operating aid 12 of the present invention. Referring first to FIG. 2, lighter 10 is shown with thumb lever 22 in an upward position. Safety device 26 is shown in FIG. 2 in the second position, which prevents operation of thumb lever 22. More particularly, safety device 26 is biased in a radially outward direction (i.e., toward the right in the drawing of FIG. 2), and is disposed between thumb lever 22 and body 14. A shoulder 30 on safety device 26 overhangs a portion of body 14 and prevent depressing of thumb lever 22. This in turn prevents the release of fuel from the fuel tank disposed within body 14.

When moved in a radially inward direction as indicated by arrow 32 (FIG. 2), safety device 26 is disposed in the first position (FIG. 3) releasing shoulder 30 from body 14, thereby allowing operation of thumb lever 22 in a downward direction as indicated arrow 34. This allows release of the fuel from the fuel tank of body 14 while permitting rotation of thumb wheel 20, resulting in the generation of a flame 36 upon ignition from sparks produced by thumb wheel 20. When thumb lever 22 is released and biased (such as by a spring) to its upward position shown in FIG. 2, safety device 26 is again biased to the second position shown in FIG. 2 preventing operation of thumb lever 22.

Referring again to FIG. 1, the interaction between lighter operating aid 12 and safety device 26 will be described in further detail. To wit, as indicated above, safety device 26 is movable in a radially inward direction to allow depressing of thumb lever 22. Rather than safety device 26 being biased back to the radially outward position as shown in FIG. 2, protuberance 28 maintains safety device 26 in the radially inward position as shown in FIGS. 1 and 3. Thumb lever 22 can thus be depressed without the need to reset safety device 26 between actuations of thumb lever 22. Lighter operating aid 12 therefore allows a person with impaired or limited manual dexterity to operate lighter 10.

Figure 4:
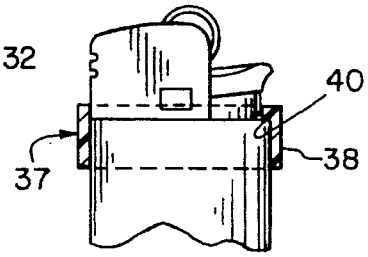
FIG. 4 is a fragmentary side sectional view of another embodiment of the lighter operating aid of the present invention, in the form of a ring disposed about a gas-fueled lighter.

Referring now to FIG. 4, another embodiment of a lighter operating aid 37 of the present invention in the form of a ring 38 is shown. Ring 38 only partially covers lighter body 14. As with the embodiment shown in FIG. 1, ring 38 also includes a protuberance 40 which extends therefrom. The interaction between protuberance 40 and safety device 26 is the same as that which is described above with reference to the embodiment shown in FIG. 1.

Figure 5:
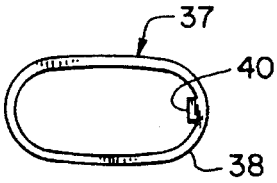
FIG. 5 is a top view of the ring shown in FIG. 4.

FIG. 5 is a top view of lighter operating aid 37 shown in FIG. 4. As shown, protuberance 40 extends in a radial direction. It will be appreciated that a top view of lighter operating aid 12 shown in FIG. 1 is substantially the same as the embodiment illustrated in FIG. 5.

Figure 6:
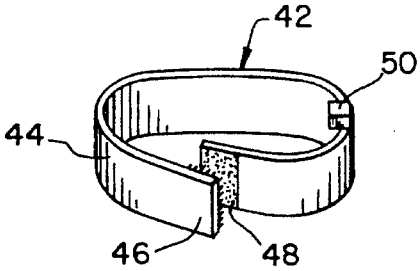
FIG. 6 is a perspective view of another embodiment of the lighter operating aid of the present invention, in the form of a strap with mating hook and loop connectors at each end.

Referring now to FIG. 6, another embodiment of a lighter operating aid 42 is shown. Lighter operating aid 42 is in the form of a strap 44 having mating connectors 46, 48 at opposing ends thereof. Connectors 46, 48, in the embodiment shown, are in the form of hook and loop connectors, respectively. A protuberance 50 is attached to and extends from strap 44 in a radially inward direction. Lighter operating aid 42 may thus be used with a lighter having a safety device which is movable in a radial direction, such as in the embodiment of lighter 10 shown in FIGS. 1–4.

Figure 7:
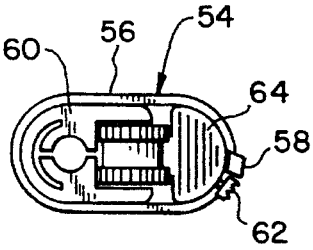
FIG. 7 is a top view of another embodiment of a lighter operating aid of the present invention.

FIG. 7 is a top view of another embodiment of a lighter operating aid 54 of the present invention. Sleeve 56 can be in the form of either a cover as shown in FIG. 1 or a ring as shown in FIG. 4, and includes a protuberance 58 which is attached to and extends therefrom. Lighter 60 shown in FIG. 7 includes a safety device 62 which is movable in a generally sideways direction relative to the longitudinal axis of lighter 60 between a first position allowing operation of thumb lever 64 (shown in FIG. 7) and a second position preventing operation of thumb lever 64. Thus, rather than biasing safety device 62 in a radially inward direction, protuberance 58 extends in an axial direction relative to the body of lighter 60, and maintains safety device 62 in the first position after movement thereof in the sideways direction. Thumb lever 64 can thus be repeatedly depressed for operating lighter 60.

Figure 8:
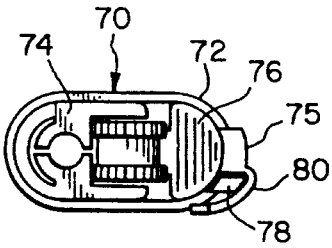
FIG. 8 is a top view of another embodiment of a lighter operating aid of the present invention.

Referring now to FIG. 8, another embodiment of a lighter operating aid 70 is shown. Lighter operating aid 70 includes a sleeve 72 which at least partially surrounds and slidably engages the body of a lighter 74. In contrast with lighters 10 and 60 shown in FIGS. 1 and 7, lighter 74 includes a safety device 75 which must be maintained in a radially outward direction in order to depress thumb lever 76. Sleeve 72 thus includes a protuberance 78 which extends in an axial direction relative to the body of lighter 74. Protuberance 78 engages an ear 80 of safety device 75, and thus maintains safety device 75 in the radially outward position allowing repeated depressing of thumb lever 76.

In use, a lighter operating aid 12, 37, 42, 54 or 70 is slid over the body of a lighter such that the respective protuberance 28, 40, 50, 58 or 78 engages the safety device of the lighter and maintains the safety device in a position allowing repeated depressing of the thumb lever.

As is apparent from the above descriptions of the embodiments of lighter operating aids 12, 37, 42, 54, and 70, the protuberance can be attached to or integral with the sleeve, and can be configured with any number of geometric shapes which enable the safety device to be held in the position which allows repeated depressing of the thumb lever without continually resetting the safety device. Thus, it will be appreciated that any number of differently configured protuberances which are attached to a sleeve can be used in conjunction with different makes of lighters having safety devices incorporated therein.

Additionally, in the embodiment shown in the drawings, the sleeve of the lighter operating aid slides over and engages the body of the lighter. However, it is also to be understood that a lighter may be manufactured with a lighter operating aid attached thereto. For example, a sleeve which at least partially surrounds the lighter body can have an adhesive backing which attaches the sleeve to the lighter body. If an individual has limited manual dexterity, or is in a household with no children present, the sleeve can be left on the lighter body using the adhesive backing. On the other hand, if children are present in the household, the adhesive backed sleeve can be separated from the lighter body, thereby rendering the safety device operable.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed:

1. lighter operating aid for a gas-fueled lighter, the lighter including a body with a fuel tank therein, an igniting mechanism including a thumb lever which controls a supply of fuel from the fuel tank, and a safety device which is movable between a first position allowing operation of the thumb lever and a second position preventing operation of the thumb lever, said lighter operating aid comprising:

a sleeve for at least partially surrounding and engaging the body of the lighter;

a protuberance which extends from said sleeve, said protuberance being structured and arranged to maintain the safety device in the first position allowing operation of the thumb lever when said sleeve engages the lighter.

2. The lighter operating aid of claim 1, wherein said sleeve comprises a cover which substantially covers the lighter body.

3. The lighter operating aid of claim 1, wherein said sleeve comprises a ring which partially covers the lighter body.

4. The lighter operating aid of claim 1, wherein said sleeve comprises a strap having mating connectors at each end thereof.

5. The lighter operating aid of claim 4, wherein said connectors comprise hook and loop connectors, respectively.

6. The lighter operating aid of claim 1, wherein said protuberance extends in a radial direction relative to the lighter body when said sleeve engages the lighter body.

7. The lighter operating aid of claim 1, wherein said protuberance extends in an axial direction relative to the lighter body when said sleeve engages the lighter body.

8. The lighter operating aid of claim 1, wherein the safety device is moved in a radial direction relative to the lighter body when in the first position, said protuberance maintaining the safety device in the radially moved first position.

9. The lighter operating aid of claim 1, wherein the safety device is moved in a sideways direction relative to the lighter body when in the first position, said protuberance maintaining the safety device in the sideways moved first position.

10. The lighter operating aid of claim 1, wherein said sleeve and said protuberance are monolithically formed together.

11. A lighter assembly, comprising:

a gas-fueled lighter including a body with a fuel tank therein, an igniting mechanism including a thumb lever which controls a supply of fuel from the fuel tank, and a safety device which is movable between a first position allowing operation of the thumb lever and a second position preventing operation of the thumb lever; and a lighter operating aid, including:

a sleeve for at least partially surrounding and engaging the body of the lighter; and a device which extends from said sleeve, said device being structured and arranged to maintain the safety device in the first position allowing operation of the thumb lever when said sleeve engages the lighter.

12. A method of operating a gas-fueled lighter, the lighter including a body with a fuel tank therein, an igniting mechanism including a thumb lever which controls a supply of fuel from the fuel tank, and a safety device which is movable between a first position allowing operation of the thumb lever and a second position preventing operation of the thumb lever, said method comprising the steps of:

sliding a sleeve over at least a portion of the body of the lighter, said sleeve having a protuberance which extends therefrom;

moving the safety device to the first position allowing operation of the thumb lever; and engaging the protuberance with said safety device, whereby said protuberance maintains the safety device in the first position allowing operation of the thumb lever.

13. The method of claim 12, wherein said engaging step allows repeated operation of the thumb lever.

14. The method of claim 13, wherein said repeated operation of the thumb lever is possible with the use of only one hand.

15. A lighter operating aid for a gas-fueled lighter, the lighter including a body with a fuel tank therein, an igniting mechanism including a thumb lever which controls a supply of fuel from the fuel tank, and a safety device which is movable between a first position allowing operation of the thumb lever and a second position preventing operation of the thumb lever, said lighter operating aid comprising:

a sleeve for at least partially surrounding and engaging the body of the lighter, said sleeve including a portion thereof which is structured and arranged to maintain the safety device in the first position allowing operation of the thumb lever when said sleeve engages the lighter.

* * * * *

UNITED STATES PATENT AND TRADEMARK OFFICE

CERTIFICATE OF CORRECTION

PATENT NO. : 5,562,439

DATED : October 8, 1996

INVENTOR(S) : Todd W. VanWagner

It is certified that error appears in the above-indentified patent and that said Letters Patent is hereby corrected as shown below:

Column 1

Line 58, delete "ill" and substitute --in-- therefor.

Signed and Sealed this

Thirty-first Day of December, 1996

Bruce Lehman

*Attest:*

BRUCE LEHMAN

*Attesting Officer*

*Commissioner of Patents and Trademarks*